US006698758B2

(12) United States Patent
Hodge

(10) Patent No.: US 6,698,758 B2
(45) Date of Patent: Mar. 2, 2004

(54) CARD GAME

(76) Inventor: William O. Hodge, P.O. Box 191536, Mobile, AL (US) 36619

( * ) Notice: Subject to any disclaimer, the term of this patent is extended or adjusted under 35 U.S.C. 154(b) by 0 days.

(21) Appl. No.: 10/128,935

(22) Filed: Apr. 23, 2002

(65) Prior Publication Data

US 2002/0153663 A1 Oct. 24, 2002

Related U.S. Application Data

(60) Provisional application No. 60/285,680, filed on Apr. 23, 2001.

(51) Int. Cl.[7] ..... A63F 1/00
(52) U.S. Cl. ..... 273/274; 273/292
(58) Field of Search ..... 273/274, 309, 273/292

(56) References Cited

U.S. PATENT DOCUMENTS

| | | | | | |
|---|---|---|---|---|---|
| 5,098,107 | A | * | 3/1992 | Boylan et al. | 273/292 |
| 5,577,731 | A | * | 11/1996 | Jones | 273/292 |
| 5,984,308 | A | * | 11/1999 | Herrmann | 273/292 |
| 6,179,292 | B1 | * | 1/2001 | Aramapakul | 273/292 |
| 6,293,551 | B1 | * | 9/2001 | Webb | 273/292 |
| 6,345,824 | B1 | * | 2/2002 | Selitzky | 273/292 |

* cited by examiner

*Primary Examiner*—William M. Pierce

(57) ABSTRACT

The invention is a card game having multiple suits where one suit is selected as a bonus suit. Cards of the bonus suit provide a multiplier amount which multiplies the primary wager or a jackpot wager. With a jackpot wager, this multiplier allows the bet to be totally separate from the primary bet so that it can be made with any game where a limited number of cards are dealt. The jackpot wager is not payed unless the primary bet is won.

12 Claims, 4 Drawing Sheets

Figure 3

| Payouts: | | | X ♥'s Payouts: |
|---|---|---|---|
| Blackjack | - | 5 to 1 | A, 2, 7, 8, 9, 10, J, Q, K of ♥ = 2 x win |
| 4 cards or less = 21 | - | 2 to 1 | 3 of ♥ = 3x win |
| 4 cards or less = 20 | - | 4 to 1 | 4 of ♥ = 4x win |
| 4 cards or less = 19 | - | 3 to 1 | 5 of ♥ = 5x win |
| 4 cards or less = 18 | - | 2 to 1 | 6 of ♥ = 6x win |
| 4 cards or less = 17 | - | 1 to 1 | |

Over 21 loses wager
16 or less loses wager

CARD GAME

PRIORITY

This patent is a continuation of Provisional Patent No.: 60/285,680 filed Apr. 23, 2001.

BACKGROUND OF INVENTION

1. Field of Invention

The invention applies to jackpot games played with traditional card games.

2. General Discussion of the Invention

The game designer picks one bonus suit which for purposes for discussion will be the suit of hearts. The game is then played in accord with rules for a game of chance from the group comprised of poker, black jack, or the like.

If a card from the bonus suit (hearts) is the opening card for a player, it will trigger a multiplier, of which will be reflected by the card.

A poker game (with or without shared cards) where the house has a hand, could also use these rules. In one example, this would involve Carribean Stud where the player's hand beats or loses to a house hand. The same rules could apply to a game without consecutive cards dealt. In such a case, any multiplier card could result in a win. The player has even more incentive to continue play if a multiplier hand is received.

These and other objects and advantages of the invention win become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein:

FIG. 3 shows how the awards and multipliers may be shown to players at a location 9 on the table 10 or above the slot machine shown in FIG. 2.

DETAILED DESCRIPTION OF THE PREFERRED EXEMPLARY EMBODIMENTS

Figure 1:
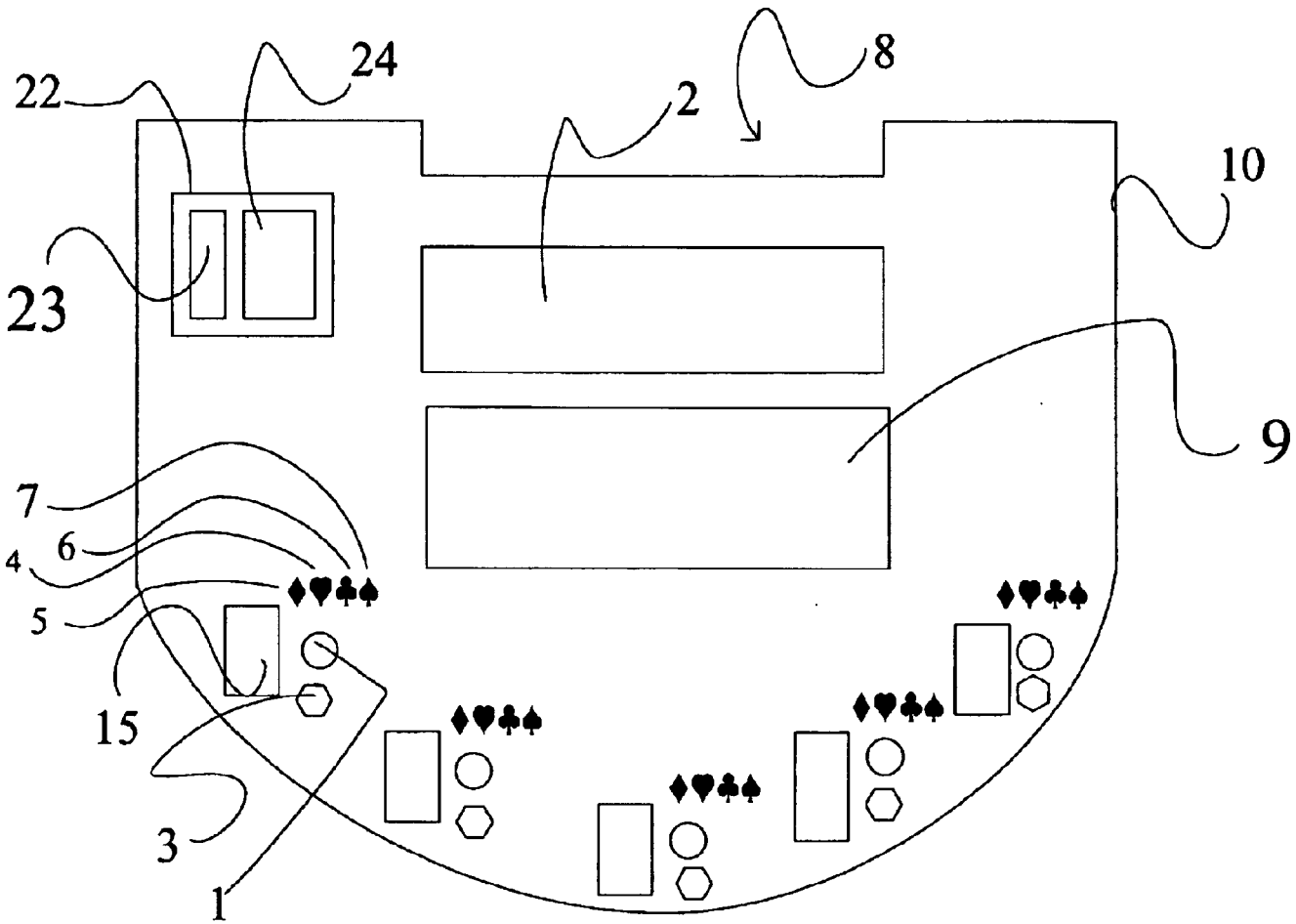
FIG. 1 shows a table for dealing the game using blackjack rules.

Referring to FIG. 1 it can be seen that the invention can be used with a table 10 having a cash drawer 2, wager locations 3, player locations 15, dealing locations 8, and jackpot wager locations 1.

The game may be played in accord with accepted rules of the game, here blackjack with the wager for the game of blackjack being made at wager location 3. When the player wishes to enhance his payout, he may make a wager in the jackpot wager location 1 at which time the rules of the jackpots are as follows. Since the jackpot wager depends on which suit is the jackpot suit, in one embodiment a heart 4, diamond 5, club 6 and spade 7 location are available so that the player may pick the bonus suit by placing the wager on one of the bonus choices 4, 5, 6, and 7. The bonus suit could also be picked at random based on a roll of a dice 26 which has each bonus suit on it before or after the deal. The dice 26 may be rolled.

Two wagers then can be made in a single play of the cards. The first pays only according to standard blackjack rules. The second pays according to the rules of the new game.

In the preferred embodiment the multiplier for the first 6 cards, two through six, will be the value of that card times the jackpot wager at the jackpot wager location. In this way a 2 will be two times the jackpot wager at the jackpot wager location, a 3 will be three times the jackpot wager at the jackpot wager location, and a 4 will be four times the jackpot wager at the jackpot wager location, a 5 will be five times the jackpot wager at the jackpot wager location and a 6 will be six times the jackpot wager at the jackpot wager location.

Any of the other cards could be assigned an increase to the wager pot at the jackpot wager location. For example, all the other cards from the bonus suit could be one and a half times, or two times the jackpot wager at the jackpot wager location.

In order to take advantage of this multiplier, the player would have to match the front line bet on the outcome of the game, in FIG. 1 Blackjack, with a bet at the jackpot wager location 1 of equal size based on the multiplier.

Not withstanding the winning of the multiplier, by receiving a card of the appropriate suit as the first card received, the player would loss all bets if the jackpot hand which was the subject of the frontline bet did not beat the dealers frontline bet or if the player busted before the dealer busted or make a hand.

In addition the player might be given an added bonus for each card from the bonus suit received after the first card if the first card was a heart (the bonus suit in this example). This could be limited to sequential cards from the bonus suit, for example, a 2 of hears followed by a 4 of hearts would have a 6 times multiplier if hearts were the bonus suit.

Non sequential reception of bonus cards could also be added. For example, if the first card was a heart, the second card was a club and the third was a heart, the first and third card could be added for a multiplier. Alternatively, the second bonus card might have a lower bonus amount, the first bonus amount and one half of the second bonus amount in such an example.

A third alternative would provide the second or third card from the bonus suit might only be a fraction, such as one half of its normal multiplier value. This one half rule might only apply if there is an intervening card in order to add more excitement to the game. A method of tracking sequential and intervening cards, however, would be required.

A jackpot could be based on receiving a predetermined number of consecutive (or not) bonus cards, for example five hearts, without busting. This jackpot could start off as a fairly large bet and could receive a portion of each wager made and might also be a subject of a $1 ante bet. This would, of course, require the player receive five cards without busing, but it need not require that the five cards, all being hearts, would beat the dealer hand since this could be a completely separate side bet which was not dependant on the primary bet in order to win. An alternative would be to receive a certain number of bonus points or to receive the bonus cards in a certain order or to have the bonus card followed by all the matching cards (four of a kind) from non bonus suits (here a spade, club and diamond), for example a five of hearts bonus card followed by three five's of the other three suits (clubs, diamonds and spades). In this was different amounts of bonus could be given for different matches of bonus cards. For example four two's would be a one-quarter bonus, four three's would be a one-half bonus, four four's would be a three-quarter bonus, and four five's would be a 100% of the jackpot as an example.

In order to make the game more practical, it could be possible that the jackpot wager could be a smaller wager than the frontline bet and that the multiplier effect would only be effective as to the percentage of the wager multiplier.

This game can be played as a regular Blackjack game without betting on the jackpot wager location, but if the player received a multiplier card, his winnings would not be multiplied. If a player did choose to place the jackpot wager at the wager location, in the preferred embodiment, the jackpot wager will be the exact amount of the regular Blackjack bet at the wager location. In the event that his first card is not a heart, the player would lose his jackpot wager and the game continues as Regular Blackjack. If the first card is a heart and hearts are the bonus suit and the player won the Blackjack hand, his total bet would be multiplied as follows:

A, 2, 7, 8, 9, 10, J, Q, & K of Hearts=2×bet 3 of Hearts=3×bet ($3.00 for a $1.00 bet)

4 of Hearts=4×bet ($4.00 for a $1.00 bet)

5 of Hearts=5×bet ($5.00 for a $1.00 bet)

6 of Hearts=6×bet ($6.00 for a $1.00 bet)

Figure 2:
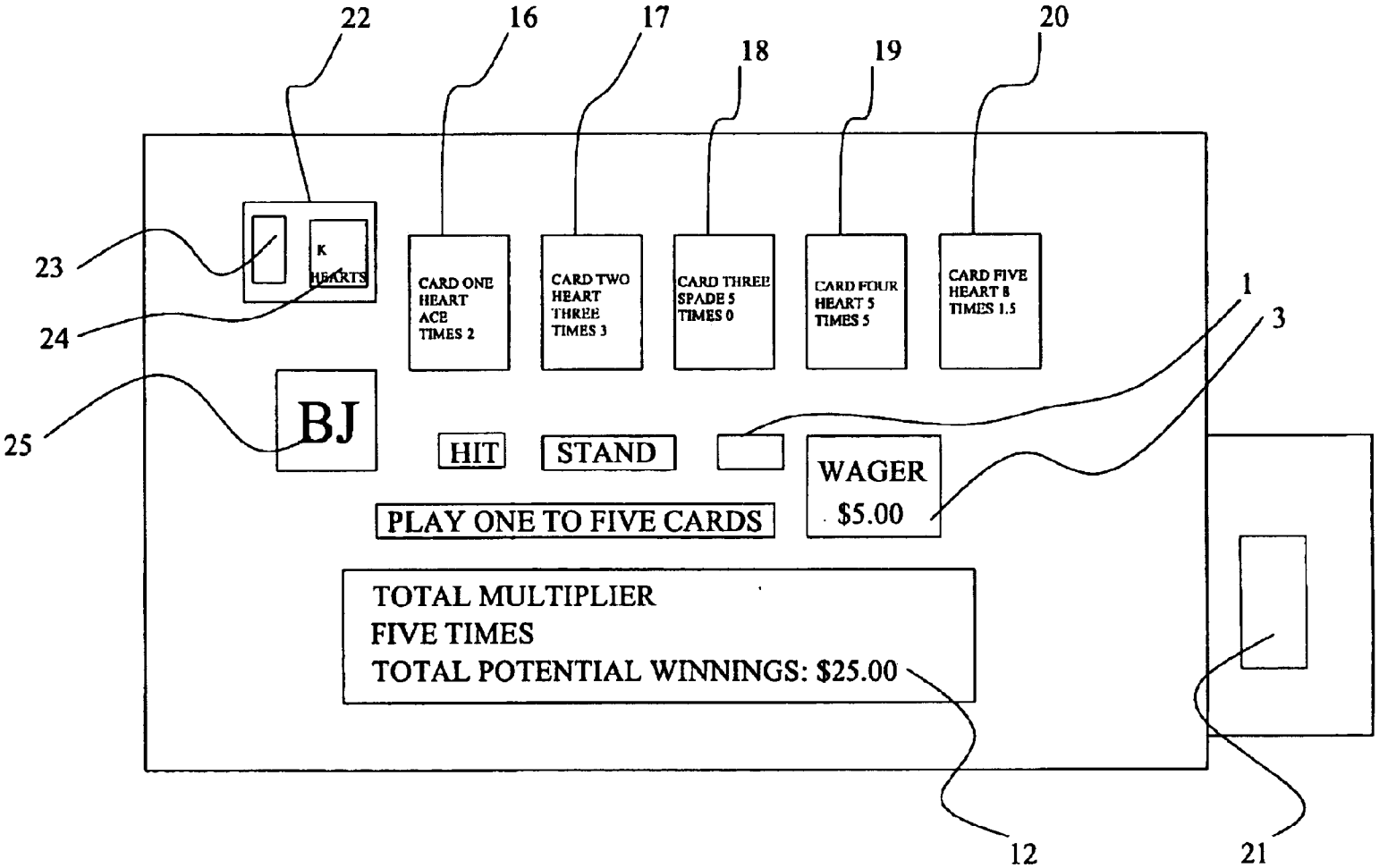
FIG. 2 shows a slot game format.
Figure 4:
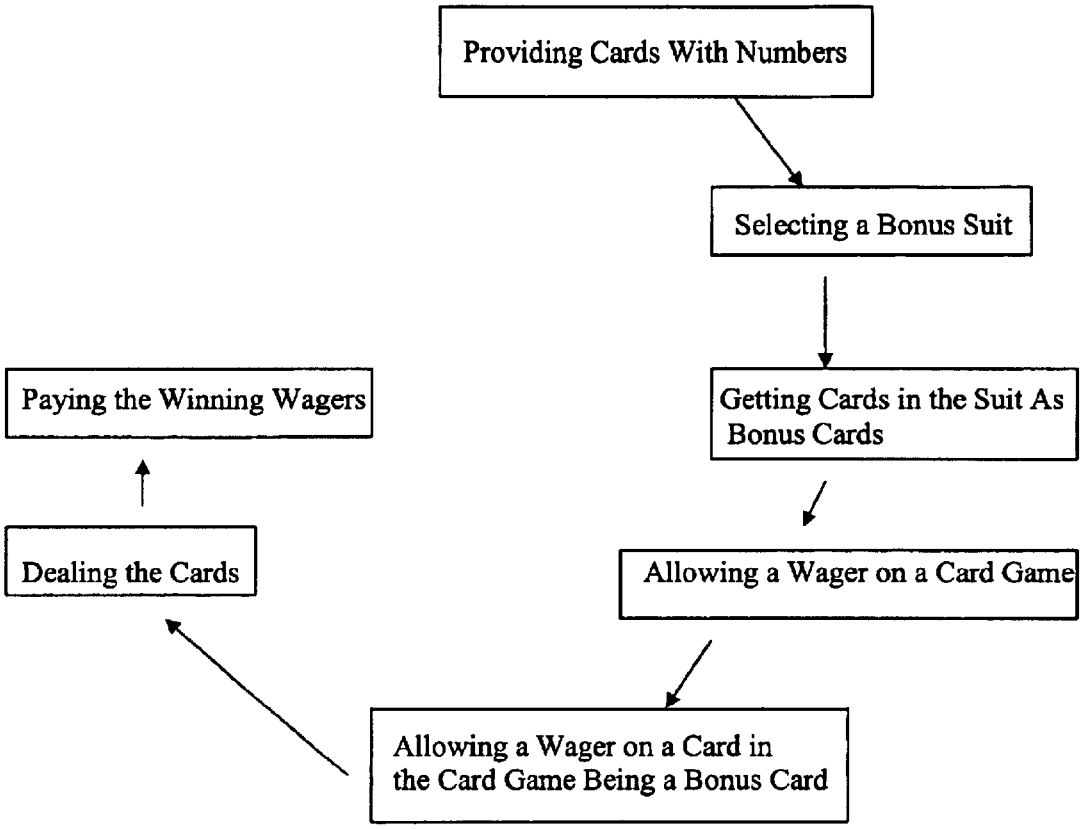
FIG. 4 shows the steps listed in the form of a flow chart diagram.

Since the multiplier amount could be shown on the card as a separate figure as shown in FIG. 2, multiplier cards could be randomly inserted into the deck. Here, the game may be played by setting out the rules with out picking the cards. Each card with a bonus or multiplier may be referred to as a bonus card.

By way of example, if a player's first card is a heart and his winning Blackjack hand contains more than one X Hearts card all X Hearts cards will be multiplied. A series of multiples would provide an even greater bonus.

While the suit used in the preferred embodiment is hearts, any suit could be used.

A one dollar bet for 5 Hearts without busting, in this embodiment, wins a Progressive Jackpot. Progressive Jackpot here starts of $2,000.00. A player may be made to place a one dollar Progressive Jackpot bet and the jackpot wager location 14 in order to win the Progressive Jackpot. The player may also get (2 times) 2 to 1 instead of 1½ payback for a bonus suited Blackjack (ace and face card of hearts) with all bets. Any unsuited Blackjack is paid as a regular Blackjack, 1½ to 1.

There are several alternatives to this embodiment. The method is generally set out as:

1. A side wager for a card game comprising the steps of
   a. Selecting a suit;
   b. Wagering on the following occurrence of the suit:
      i. That the first card dealt will be from preselected suit.
      ii. The method may be supplemented where the wager is increased if a second card is of the same suit as the first card.
2. The game of the prior summary where the wager is being made on poker hands from the bonus suit (strait flush, for example).
3. The game may further comprising a wager being on poker or blackjack hands from the bonus suit making a specific total (such as 7).

FIG. 2 shows a slot game format. In this embodiment a slot 21 accepts a wager. Each card 16–20 here shows whether it has a multiplier or not. Here 16, 17, 19, and 20 are multiplier cards. This shows a total multiplier 12, with 5 times the times heart, showing that only sequential hearts are added. The potential, unrecognized multiplier is shown on the remaining cards. If these were added (or multiplied) then the total 12 would have and additional 6.5 times multiple. A game indicator 25 shows this as blackjack since it could otherwise be a 5 card poker game.

The dealer hand 22 is shown as a blackjack hand with an up card 24 (a king) and a down card 23 which has an unknown value.

FIG. 3 shows how the awards and multipliers may be shown to players at a location 9 on the table 10 or above the slot machine shown in FIG. 2. The amount of the bonus could vary in accord with the percentages which were acceptable to the gaming commission in order to provide an acceptable advantage to the house or dealer of the game.

Where poker rules are used, for example, a made hand (straight, flush, royal flush, etc.) could potentially be made up of bonus cards. In such a case a bonus could be paid. This allows for games such as poker, to have a jackpot which is paid only where the bonus cards received by players make up a made hand. Because this may be a statistically insignificant event, the amount of such jackpots may be made rather large. For example, a jackpot of 500.00 could be paid for players making a jackpot wager that they will receive a straight, but the jackpot could be larger, or even progressive, for a jackpot wager where they receive a royal flush. Since five cards may be receive in a blackjack game, by five different players or (with lower numbers) a single player, these same made hands may result in a jackpot for a blackjack player. For example, the single player may wager on the jackpot wager 5.00. If the player gets ace, two, three, four, five of the bonus suit, then the player could receive a jackpot of progressive proportions, the statistical significance of such a hand being very limited.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A method of providing a side wager with a bonus payout for a card game having at least one hand comprised of at least one card with at least one player said card game having a card deck comprised of a plurality suits with each suit comprising a plurality of cards having a number, and an outcome comprised of a winning hand and a losing hand comprising the steps of:

(1) selecting a bonus suit from the plurality of suits comprising a plurality of bonus cards;

(2) providing at least one bonus card in the bonus suit and wherein the bonus cards have a number;

(3) allowing for a first wager on the outcome of the card game;

(4) allowing a bonus wager on the at least one player receiving the at least one bonus card in the at least one hand and wherein the amount of bonuses varies from one bonus card to the next;

(5) dealing at least one hand to the at least one player;

(6) paying a bonus payout on the bonus wager if the hand contains the at least one bonus card and wherein the amount of the bonus varies from one bonus card to the next and wherein bonus payout is the bonus wager multiplied by the number on the at least one bonus card.

2. The method of claim 1 wherein the step of paying the bonus wager further comprises the paying the bonus wager if the first wager is won.

3. The method of claim 1 wherein the step of paying the bonus wager further comprises paying the bonus wager if the first card dealt to the player is a bonus card.

4. The method of providing a side wager of claim 1 wherein the steps of dealing further comprises sequentially dealing at least two cards in the at least one hand and wherein the amount of the bonus payout is determined by adding the at least one bonus card received sequentially in the hand to obtain a sum and multiplying the sum times the bonus wager.

5. The method of providing a side wager of claim 4 wherein the steps of dealing further comprises dealing at least two cards in the hand and wherein the amount of the bonus is determined by adding the at least one bonus card received in the hand to obtain a sum and multiplying the sum times the bonus wager.

6. The method of providing a side wager of claim 1 wherein the card game is a game from a group of games consisting of the group comprised of pai gow, poker, blackjack, baccarat and other prior art casino card games.

7. The method of providing a side wager of claim 1 and other casino card games wherein the step of paying the bonus wager further comprises the paying the bonus wager if the at least one player receives at least two bonus cards in the at least one hand.

8. The method of claim 1 wherein the amount of the bonus wager payout varies according to the statistical difficulty of obtaining the first wager.

9. The method of claim 1 wherein the step of selecting a bonus suit further comprises the at least one player selecting a bonus suit prior to placing the bonus wager.

10. The method of claim 1 wherein the step of selecting a bonus suit further comprises the dealer selecting the bonus suit.

11. The method of claim 1 wherein the step of selecting a bonus suit further comprises using a random selector means to select from the plurality of suits.

12. The method of claim 1 wherein the card deck comprises a standard 52 card deck of cards having a bonus suit selected from hearts, diamond, spades and clubs of the card deck.

* * * * *